United States Patent [19]

Kyhl et al.

[11] Patent Number: 5,050,524

[45] Date of Patent: Sep. 24, 1991

[54] FLOATING CONCRETE DOCK SECTIONS AND METHOD OF CONSTRUCTION

[76] Inventors: John P. Kyhl, 3558 Muirfield Dr., Titusville, Fla. 32780; Arnold A. Finn, 3605 Conway Garden Rd., Orlando, Fla. 32809

[21] Appl. No.: 191,333

[22] Filed: May 9, 1988

[51] Int. Cl.[5] ..... B63B 35/38

[52] U.S. Cl. ..... 114/263; 114/266; 114/267

[58] Field of Search ..... 114/263, 266, 267; 405/218, 219

[56] References Cited

U.S. PATENT DOCUMENTS

| | | | |
|---|---|---|---|
| 4,263,865 | 4/1981 | Shorter | 114/267 |
| 4,318,361 | 3/1982 | Sluys | 114/267 |
| 4,365,914 | 12/1982 | Sluys | 114/267 |
| 4,470,365 | 9/1984 | Sluys | 114/267 |
| 4,559,891 | 12/1985 | Shorter | 114/267 |
| 4,715,307 | 12/1987 | Thompson | 114/267 |
| 4,947,780 | 8/1990 | Finn | 114/267 |

*Primary Examiner*—Sherman Basinger
*Assistant Examiner*—Stephen P. Avila
*Attorney, Agent, or Firm*—Mac Donald J. Wiggins

[57] ABSTRACT

A concrete dock section has a polyfoam billet coating having sides and bottom coated with a fiberglass-cement mixture, and a top surface having a plurality of transverse channels. A concrete dock surface is poured over the channels which have a steel through rod centered in each. The top surface of the billet extends slightly over the billet sides and the concrete deck edges extend downward to engage the extended top surface. The deck section is made by coating the billet in an inverted position, placing the billet in a pouring collar the top surface of the billet, installing the through rods, and pouring concrete to the top of the pouring collar.

6 Claims, 3 Drawing Sheets

FLOATING CONCRETE DOCK SECTIONS AND METHOD OF CONSTRUCTION

BACKGROUND OF THE INVENTION

1. Field of the Invention

The present invention relates to floating docks, and more particularly to a floating concrete surfaced dock and the method of making same.

2. Description of the Prior Art

It is desirable and known in the prior art to utilize floating dock structures to avoid the problems common to fixed docks, such as deterioration of wood pilings, damage from storms, and flooding in high water.

One type of floating dock having a concrete surface is known, as exemplified by U.S. Pat. No. 4,715,307, to Thompson.

This type is constructed in an inverted position by pouring a layer of aggregate concrete into a form over a texturing mat, placing a buoyant float element over the mat, and spraying a layer of fiberglass reinforced cement over the buoyant float element. A matrix of Portland cement with a plurality of fiberizable glass composition suitable for covering buoyant float elements formed from expanded polystyrene is disclosed in U.S. Pat. No. 4,118,239 to Gagin. Toby et al. teach flotation units using deck elements requiring steel reinforcing bars or mesh. The walls of flotation chambers are also steel reinforced and tied to the deck reinforcements. The flotation chambers are filled with expanded polystyrene.

The Toby et al. system of steel and concrete require larger float elements to support the increased weight and requires complex fabrication molds, jigs and procedures. The Thompson float is somewhat simpler than the Toby et al. structure. However, the method requires construction of the entire float in an inverted position using a mold for the top deck layer. Thus, the quality of device cannot be determined until after the float is completed and the concrete materials have set. Voids may occur and it is difficult to maintain exact dimensions.

There is a need for a simplified floating dock section and method of construction which permits access to the top deck during finishing of the surface thereof and which permits close quality control.

SUMMARY OF THE INVENTION

The floating dock section of the invention includes a rectangular expanded polystyrene billet having a plurality of rectangular transverse channels in the top surface thereof. The side and bottom surfaces are coated with a fiberglass-cement mixture. A through rod with internally threaded ends is disposed in each transverse channel which are filled with aggregate concrete surrounding the rods. The concrete beams thus formed are integral with a concrete deck of about 1½ inches in thickness which extends about 3 inches beyond the sides of the billet and projects downward about 10 inches as will be discussed more fully below.

As mentioned above, the floating dock section has a float portion formed from expanded polystyrene or the like. This material is available in large blocks. In accordance with the method of the invention, a block is cut to form an approximately rectangular float element having a flat top surface. For large dock sections, the float portion may be built up by gluing blocks to form a float billet having the desired dimensions. Preferably, the sides of the billet are tapered such that the base is slightly smaller than the top surface, and the top surface extends slightly beyond the tapered billet sides to provide projecting ledges around the periphery thereof.

The billet is inverted, and the side and bottom surfaces are sprayed with a glass fiber-concrete mixture to a thickness of about ⅜ inch. After the fiber-concrete mixture sets, the billet is turned with the uncoated top surface up. A plurality of rectangular blocks of expanded polystyrene having a length equal to the width of the billet are glued to the top surface so as to form a plurality of transverse channels about 4½ inches wide and 4½ inches deep.

An adjustable size, rectangular pouring collar is used to perform the next step in the method of construction. The pouring collar may be fabricated from channel iron or the like having a width of 10 inches. An adjustable horizontal shelf element projects inwardly from each of the bottom surfaces of the channel iron sections. The collar is supported by stands and the billet is placed within the collar. The projecting ledges rest on the shelf elements to support the billet within the pouring collar. A plurality of through rods having internally threaded ends is disposed in the transverse channels and supported therein by bolts through holes in the longitudinal channel iron portions of the pouring collar.

The top surfaces of the pouring collar extend about 1½ inches above the top surfaces of the groove-forming blocks.

Concrete is poured into the collar and flows into the transverse channels to captivate the through rods and to form concrete beams. Pouring is continued to the top of the collar to produce the desired deck thickness of concrete over the billet, generally about 1½ inches. The concrete flows around the periphery and under billet projecting ledges, captivating the billet. After the concrete has cured, the bolts are removed from the ends of the through rods, and the pouring collar is removed. The dock section is then complete, ready for finishing off and assembly.

As will be recognized, the quality of construction is easily monitored as the fabrication of a dock section progresses and voids in the poured concrete may be avoided.

A plurality of dock sections may be interconnected by means of wooden wales or the like. Bolt holes in the wales, spaced to match the spacing of the through rods, permit bolting of wales to dock sections. Conventional techniques may be used to anchor the resulting dock to permit it to rise and fall with tides and other changes in water level.

It is therefore a principal object of the invention to provide a concrete surfaced floating dock section of simple construction that can be fabricated by a method providing continuous quality control.

It is another object of the invention to provide a method of construction of a concrete floating dock section which requires no molds and which utilizes pouring forms adjustable for various size sections.

It is still another object of the invention to provide a floating dock section having a fiberglass-cement mixture coated expanded polystyrene billet, and an aggregate concrete surfaced cap over the top surface of the billet which captivates the billet.

It is yet another object of the invention to provide a floating dock section having a concrete surfaced cap with internally threaded through rod connectors along longitudinal edges thereof to permit interconnection of a plurality of such sections.

These and other objects and advantages of the invention will become apparent from the following detailed description when read in conjunction with the drawings.

DETAILED DESCRIPTION OF THE PREFERRED EMBODIMENT

Figure 1:
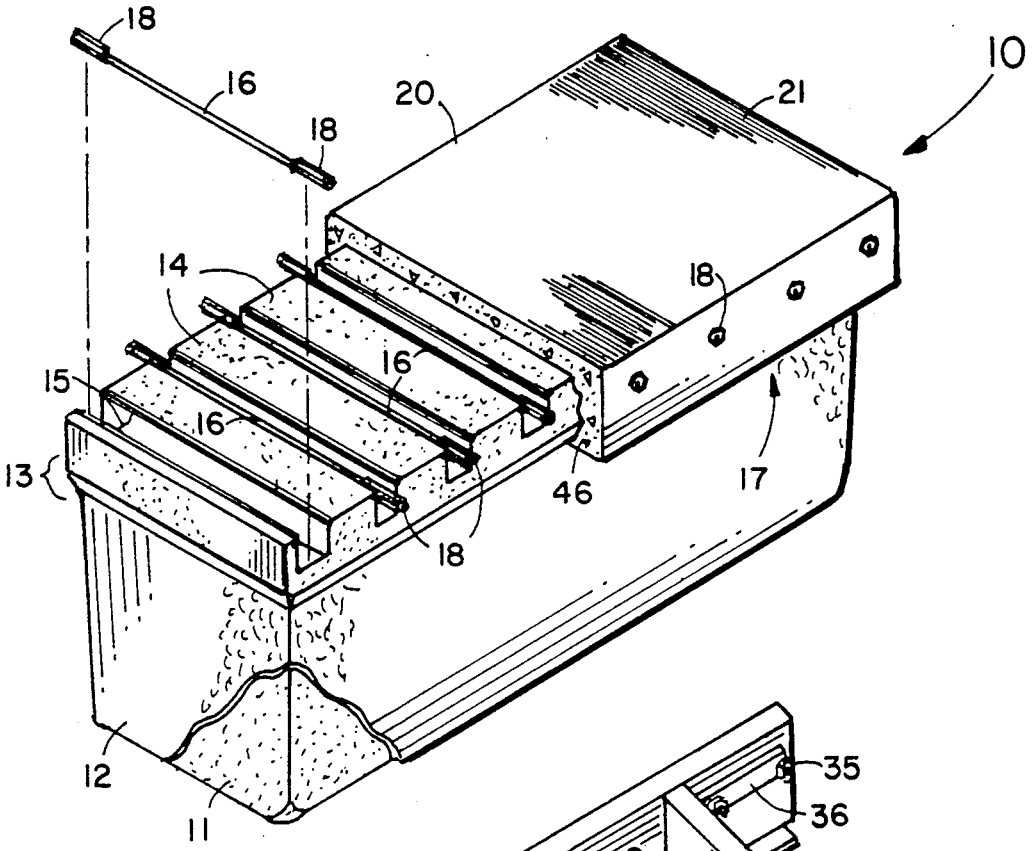
FIG. 1 is a perspective view of a floating dock section of the invention partially cut away.

Referring to FIG. 1, a perspective view of a typical dock section 10 in accordance with the invention is shown partially cut away and exploded to expose constructional features thereof. A rectangular billet 11 of expanded polystyrene (polyfoam) or the like is coated to a thickness of about ⅜ inch with a mixture of fiberglass and Portland cement 12. Billet 11 includes a projecting ledge 13 around the top periphery thereof. A plurality of transverse channels 15 is formed in the top surface of polyfoam billet 11 by polyfoam blocks 14. Channels 15 may be cut into the top surface of a billet 11 or may be formed by separate polyfoam blocks cemented to the surface.

A plurality of through rods 16, each having hexagonal internally threaded ends 18, is disposed in channels 15. Ends 18 project about 3 inches on either end from a channel 15. A concrete cap 17, shown partially cut away in FIG. 1, is formed over and captivates projecting ledge 13. As will be understood, through rods 16 are embedded in concrete in channels 15 and internally threaded ends 18 are accessible along the longitudinal edges of cap 17. Deck 20 of cap 17 may include a textured surface 21.

To fabricate dock section 10, billet 11 is cut from polyfoam which is available in large blocks and in various densities. Where the size of billet 11 is greater than that of available blocks, it may be formed in sections of polyfoam cemented together. If possible, the top surface of billet 11 may have the transverse channels 15 cut out. Alternatively, channels 15 may be formed as described hereinafter.

Billet 11 is inverted and sprayed with a mixture of fiberglass and cement. For example, the composition described by Gagin in U.S. Pat. No. 4,118,239 is suitable. The bottom and side surfaces only of billet 11 are sprayed, resulting in coating 12, shown in FIG. 1.

Figure 2:
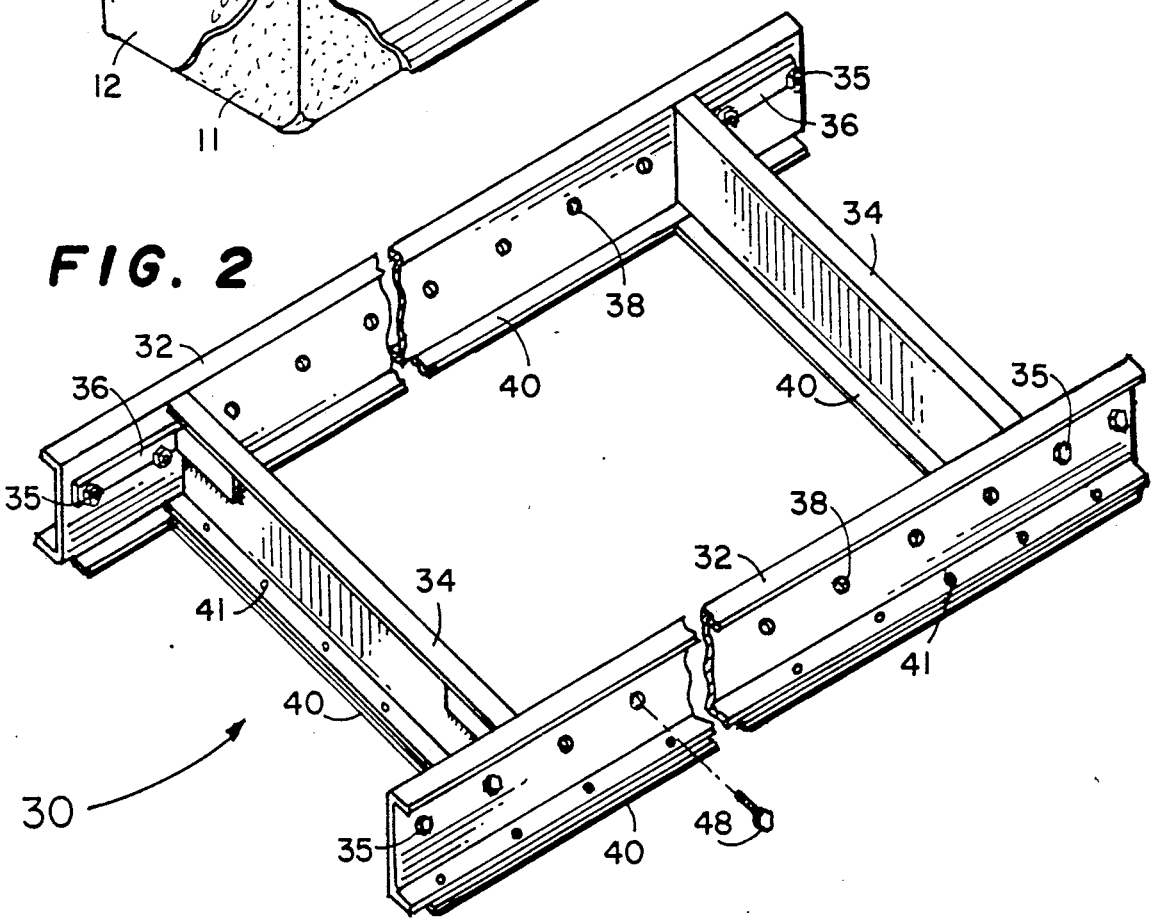
FIG. 2 is a perspective view of an adjustable pouring collar used in fabricating the dock section of FIG. 1.

To form concrete cap 10, a pouring collar 30, shown in perspective view in FIG. 2 is used. Pouring collar 30 is preferably adjustable such that dock sections 10 of differing sizes may be made without the necessity of making custom forms. A pair of longitudinal elements 32, which may be formed from 10 inch channel iron, have a series of equally spaced bolt holes 38, spaced to match the spacings of through rods 16 in flotation billet 11. For example, this spacing may be from 12 to 15 inches.

A pair of transverse elements 34 is provided, formed from 10 inch channel iron and cut for the desired width of concrete cap 17. A plurality of pairs of elements 34 may be fabricated in desired lengths to permit various width float sections to be constructed. A set of angle brackets 36 is attached to each transverse element 52 and each includes bolt holes matching holes 38 to permit fastening by bolts 35 to longitudinal elements 32. As will be understood, the length of the dock section 10 may be easily selected by adjustment of the position of transverse elements 34.

Figure 3:
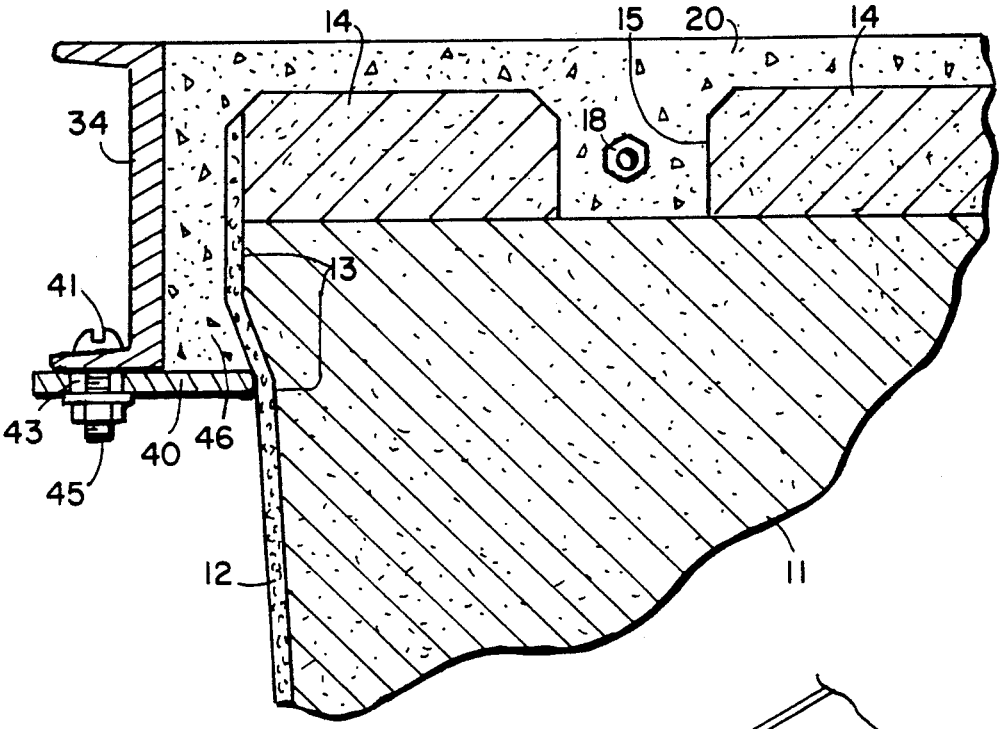
FIG. 3 is a partial cross sectional view of a dock section with the pouring collar in place.
Figure 4:
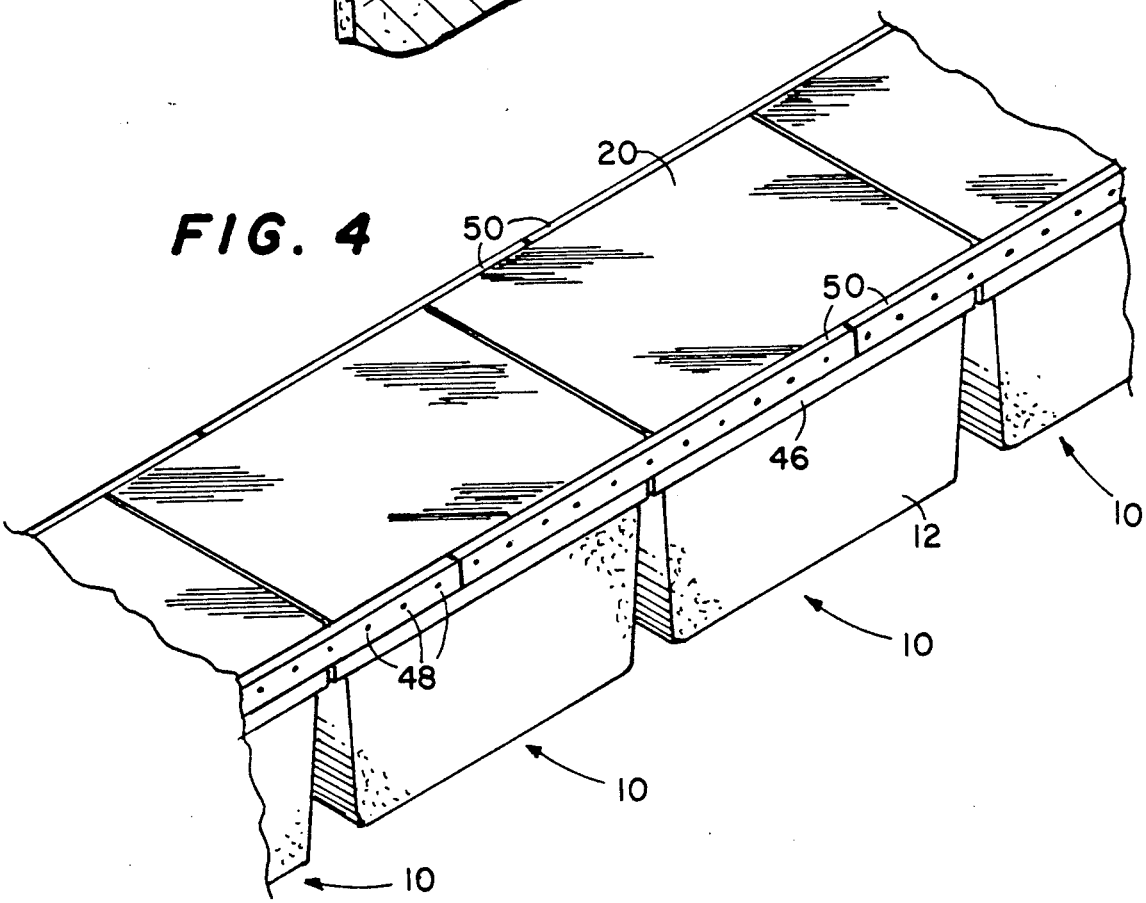
FIG. 4 is a perspective view of a set of dock sections joined to form a floating dock.

A support shelf element 40 is fastened to the lower surface of each pouring collar element 32, 34 by bolts 41 and projects about 3 inches into the collar interior. Pouring collar 30 is supported over the floor by suitable stands. Coated billet 11 is placed in pouring collar 30 with projecting ledges 13 being supported by support shelf elements 40 as best seen in the partial cross sectional view of FIG. 3. Cement 40 is seen to have a slot 43 for mounting bolt 41 which permits adjustment thereof for an accurate fit with billet 11.

As will be noted, a space between the inner face of collar member 34 and projecting ledge 13 is seen which will be present around the periphery of billet 11. After placing of billet 11 in collar 30, the ends 18 of through rods 16 are bolted to longitudinal elements 32 through bolt holes 38, centering rods 16 and ends 18 in channels 15 between polyfoam blocks 14.

Next, aggregate concrete is poured into pouring collar 30 and leveled with the top surfaces of elements 34, 32. This forms deck portion 20 and concrete beams 47 around rods 16. The space around the periphery of billet 11 fills with concrete forming a concrete key 46 to securely lock billet 11 in concrete cap 17. After the poured concrete sets and cures, pouring collar 30 is removed and dock section 10 is ready for use.

Figure 5:
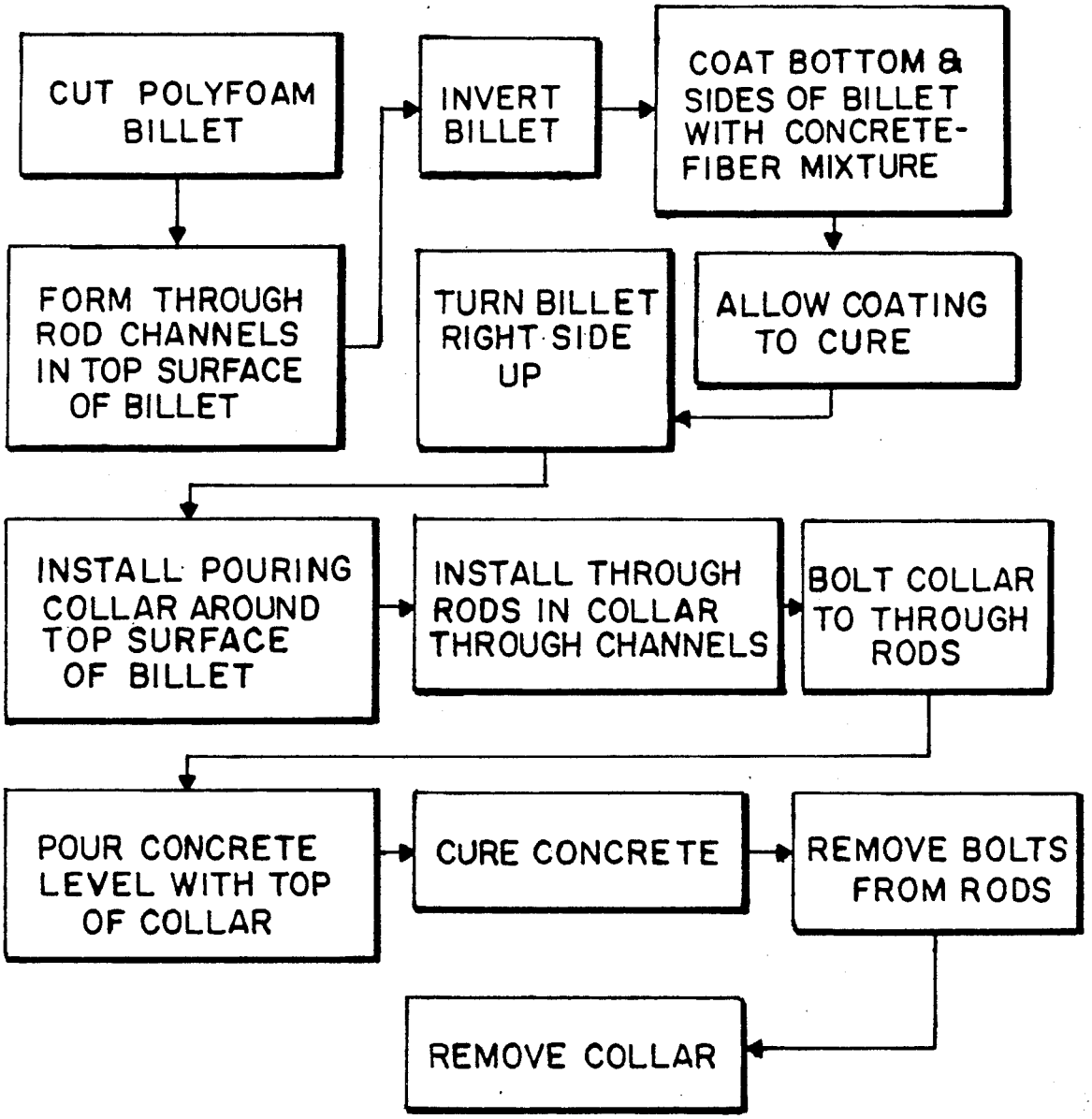
FIG. 5 is a flow diagram of a method of fabrication of the dock section of the invention.

FIG. 5 is a flow diagram of the above described method of fabricating a floating concrete dock section. In its broadest aspect, the method of the invention may include the following steps:

a) prepare a billet of expanded polystyrene;
b) coat billet with fiber-concrete mixture;
c) install pouring collar around top surface of billet;
d) pour concrete over billet to form deck;
e) permitting concrete to cure.

Variations in the design of the floating concrete dock section will be apparent to those of skill in the art and are considered to fall within the spirit and scope of the invention.

We claim:

1. A method of construction of a floating dock section comprising the steps of:

a) preparing an expanded polystyrene billet;
b) inverting the billet;
c) coating bottom and sides of the billet with a fiberglass-concrete mixture;
d) turning the inverted billet upright;
e) forming transverse channels in top surfaces of the billet;
f) installing a pouring collar around the top surface of the billet;
g) installing through rods in the transverse channels and bolting the rods to the pouring collar;
h) pouring concrete around the through rods and to the top of the pouring collar;
i) curing the concrete; and
j) unbolting and removing the collar.

2. The method as recited in claim 1 in which step (a) includes the step of providing a projecting edge around the top surface of the billet.

3. The method as recited in claim 2 in which step (f) includes the steps of:

supporting the pouring collar; and supporting the billet in the pouring collar by the projecting edge of the billet.

4. The method as recited in claim 1 in which step (c) includes the step of curing the fiberglass-cement mixture.

5. A floating dock section comprising:

an approximately rectangular billet, formed from expanded polystyrene, having a top surface, side surfaces and a bottom surface, in which said top surface extends slightly beyond said side surfaces;

a fiberglass-cement mixture coating over said side surfaces and said bottom surface of said billet;

said top surface of said billet having a plurality of parallel transverse channels formed therein;

a plurality of transverse through rods disposed in said transverse channels, said rods surrounded by concrete poured into said channels; and a concrete deck poured over said transverse channels, integral with said concrete poured in said channels, and extending downward, around and under the periphery of said extending top surface of said billet to thereby captivate said billet.

6. The floating dock section as recited in claim 5 in which a plurality of said dock sections is aligned longitudinally, and a plurality of longitudinal wales is connected to said transverse through rods of said dock sections to form a unitary floating dock.

* * * * *